US008878831B2

(12) United States Patent
Tsai et al.

(10) Patent No.: US 8,878,831 B2
(45) Date of Patent: Nov. 4, 2014

(54) PIXEL DRIVING CIRCUIT OF AN ORGANIC LIGHT EMITTING DIODE

(75) Inventors: Hsuan-Ming Tsai, Hsin-Chu (TW); Chun-Yen Liu, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 531 days.

(21) Appl. No.: 13/241,230

(22) Filed: Sep. 23, 2011

(65) Prior Publication Data

US 2012/0120042 A1 May 17, 2012

(30) Foreign Application Priority Data

Nov. 11, 2010 (TW) ..... 99138807 A

(51) Int. Cl.
*G09G 5/00* (2006.01)
*G09G 3/32* (2006.01)

(52) U.S. Cl.
CPC ..... *G09G 3/3233* (2013.01); *G09G 2300/043* (2013.01); *G09G 2300/0819* (2013.01); *G09G 2300/0814* (2013.01); *G09G 2320/045* (2013.01)
USPC ..... 345/211; 345/76; 345/82

(58) Field of Classification Search
USPC ..... 345/211, 82, 76
See application file for complete search history.

(56) References Cited

U.S. PATENT DOCUMENTS

| | | | | |
|---|---|---|---|---|
| 6,362,798 | B1 | 3/2002 | Kimura et al. | |
| 7,317,435 | B2 | 1/2008 | Hsueh | |
| 7,561,128 | B2 * | 7/2009 | Ahn et al. | 345/82 |
| 7,564,452 | B2 | 7/2009 | Komiya | |
| 2006/0077134 | A1 | 4/2006 | Hector | |
| 2007/0063932 | A1 | 3/2007 | Nathan | |
| 2008/0225025 | A1 | 9/2008 | Uchino | |
| 2011/0115772 | A1 * | 5/2011 | Chung | 345/211 |
| 2011/0157147 | A1 | 6/2011 | Tsai | |

FOREIGN PATENT DOCUMENTS

| | | | |
|---|---|---|---|
| CN | 1874627 | A | 12/2006 |
| CN | 101305409 | A | 11/2008 |
| TW | 200428348 | | 12/2004 |
| TW | I252455 | | 4/2006 |
| TW | 200717387 | | 5/2007 |
| TW | 200901128 | | 1/2009 |

* cited by examiner

*Primary Examiner* — William Boddie
*Assistant Examiner* — Leonid Shapiro
(74) *Attorney, Agent, or Firm* — Winston Hsu; Scott Margo

(57) ABSTRACT

A pixel driving circuit of an organic light emitting diode (OLED) includes a first transistor, a second transistor, a third transistor, a fourth transistor, a fifth transistor, a capacitor, and an OLED. The operation of the pixel driving circuit includes three stages including discharging, data writing, and emitting. The pixel driving circuit compensates the threshold voltage of the transistor in the stage of data writing, so the driving current of the OLED can be irrelevant to the variations of threshold voltages.

10 Claims, 6 Drawing Sheets

PIXEL DRIVING CIRCUIT OF AN ORGANIC LIGHT EMITTING DIODE

BACKGROUND OF THE INVENTION

1. Technical Field

The disclosure is related to a pixel driving circuit of an organic light emitting diode, and more particularly, to a pixel driving circuit of an organic light emitting diode that is capable of compensating a threshold voltage of a transistor.

2. Related Art

FIG. 1 is a diagram of a conventional organic light emitting diode (OLED) display panel. The display panel 10 includes a data driver 11, a scan driver 12 and a display array 13. The data driver 11 controls data lines $DL_1$-$DL_n$, and the scan driver 12 controls scan lines $SL_1$-$SL_m$. The display array 13 includes a plurality of pixel units, each disposed at corresponding intersections of the data lines $DL_1$-$DL_n$ and the scan lines $SL_1$-$SL_m$. For example, the display unit 14 is disposed at the intersection of the data line $DL_1$ and the scan line $SL_1$. As illustrated in FIG. 1, the equivalent circuit of the display unit 14 (and also those of other display units) includes a switch transistor T11, a storage capacitor C11, a driving transistor T12 and an OLED D11, where the switch transistor T11 and the driving transistor T12 are N-type transistors.

The scan driver 12 sequentially outputs scan signals to the scan lines $SL_1$-$SL_m$ so that the switch transistors in the display units coupled to a certain row are turned on at the same time, while switch transistors in the display units coupled to all other rows remain turned off. According to image data to be displayed, the data driver 11 outputs corresponding video signals (gray levels) to display units of one row via the data lines $DL_1$-$DL_n$. For example, when the scan driver 12 outputs scan signals to the scan line $SL_1$, the switch transistor T11 of the display unit 14 is turned on. The data driver 11 outputs the corresponding pixel data to the display unit 14 via the data line $DL_1$, thereby storing the pixel data voltage in the storage capacitor C11. The driving transistor T12 then provides driving current Ids to drive the OLED D11 according to the voltage stored in the storage capacitor C11.

Being a current driven component, the luminescence of the OLED D11 is determined by the value of the driving current Ids. The driving current Ids is the current flowing through the driving transistor T12, which may be represented by formula (1):

$$Ids=\tfrac{1}{2}k(Vgs-Vth)^2 \quad (1)$$

where k represents the conduction parameter of the driving transistor T12, Vgs represents the voltage difference between the source and the gate of the driving transistor T12, and Vth represents the threshold voltage of the driving transistor T12.

However, due to process factors of a thin-film transistor, transistors in different regions of the display array 13 possess varying electrical characteristics, meaning the transistors possess different threshold voltages. Hence, when transistors in different regions receive pixel data of the same voltage, the threshold voltage variation of the transistors causes the driving currents provided to the OLEDs to be inconsistent, consequently causing the OLEDs to generate different luminescence when receiving pixel data of the same voltage, and inconsistent luminance results throughout the image displayed by the display panel 10.

SUMMARY

The present invention discloses a pixel driving circuit of an organic light emitting diode. The pixel driving circuit comprises a first transistor, a capacitor, a second transistor, a third transistor, a fourth transistor, a fifth transistor, and an organic light emitting diode. The first transistor comprises a first end for receiving a data voltage, a second end, and a control end for receiving a first scan signal. The capacitor comprises a first end electrically connected to the second end of the first transistor, and a second end. The second transistor comprises a first end electrically connected to a first voltage source, a control end, and a second end electrically connected to the second end of the capacitor. The third transistor comprises a first end for receiving a first reference voltage, a second end electrically connected to the control end of the second transistor, and a control end for receiving the first scan signal. The fourth transistor comprises a first end electrically connected to the control end of the second transistor, a second end electrically connected to the second end of the first transistor, and a control end for receiving a second scan signal. The fifth transistor comprises a first end electrically connected to the second end of the capacitor, a second end, and a control end for receiving a driving enable signal. The organic light emitting diode comprises a first end electrically connected the second end of the fifth transistor, and a second end electrically connected to a second voltage source.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
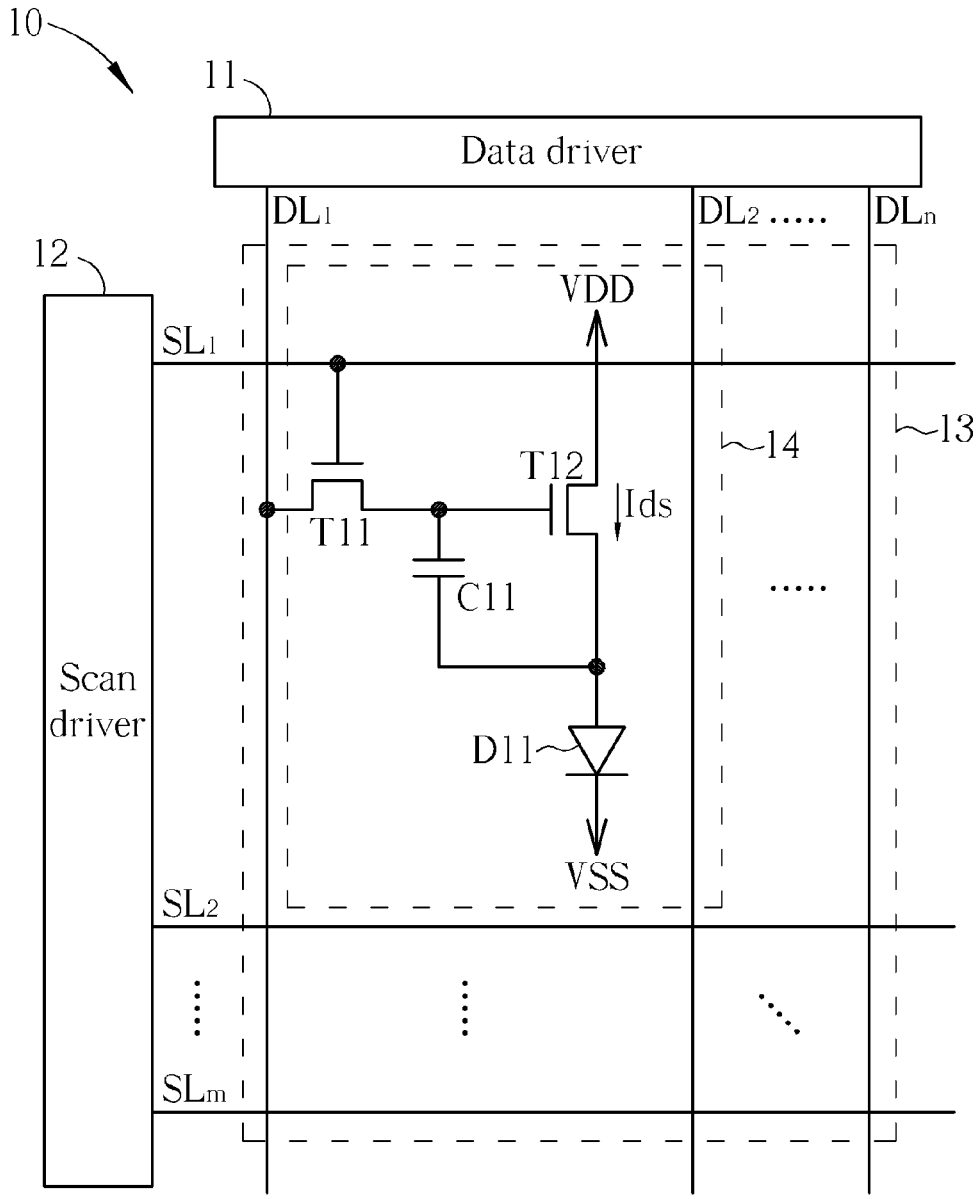
FIG. 1 PRIOR ART
FIG. 1 is a diagram of a conventional organic light emitting diode (OLED) display panel.
Figure 2:
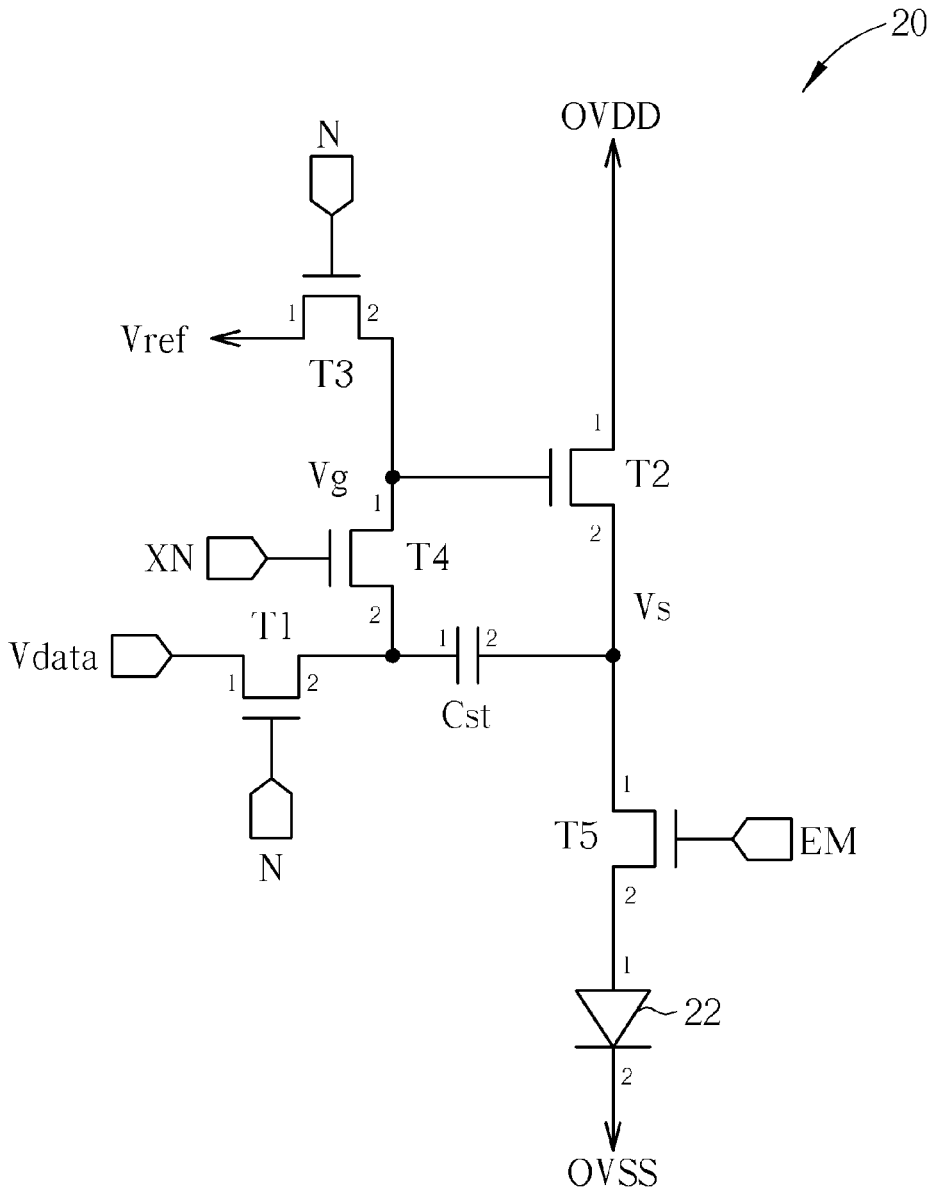
FIG. 2 is a diagram illustrating a pixel driving circuit of an organic light emitting diode according to a first embodiment of the present invention.

Please refer to FIG. 2. FIG. 2 is a diagram illustrating a pixel driving circuit of an organic light emitting diode according to a first embodiment of the present invention. The pixel driving circuit 20 comprises a first transistor T1, a second transistor T2, a third transistor T3, a fourth transistor T4, a fifth transistor T5, a capacitor Cst and an organic light emitting diode 22. A first end of the first transistor T1 receives data voltage Vdata, a control end of the first transistor T1 receives a first scan signal N, and a second end of the first transistor T1 is electrically connected to a first end of the capacitor Cst. A first end of the second transistor T2 is electrically connected to a first voltage source OVDD and a second end of the second transistor T2 is coupled to a second end of the capacitor Cst. A first end of the third transistor T3 receives a reference voltage Vref, a second end of the third transistor T3 is electrically connected to a control end of the second transistor T2 and a control end of the third transistor T3 receives the first scan signal N. A first end of the fourth transistor T4 is electrically connected to the control end of the second transistor T2, a second end of the fourth transistor T4 is electrically connected to the second end of the first transistor T1 and a control end of the fourth transistor T4 receives a second scan signal XN. A first end of the fifth transistor T5 is electrically connected to the second end of the capacitor Cst, and a control end of the fifth transistor T5 receives a driving signal EM. A first end of the organic light emitting diode 22 is electrically connected to the second end of the fifth transistor T5 and a second end of the organic light emitting diode 22 is electrically connected to a second voltage source OVSS.

In the present embodiment, the first transistor T1 to the fifth transistor T5 are N-type transistors, but are not limited to this, such that the pixel driving circuit can also be realized by utilizing P-type transistors. The first scan signal N and the second scan signal XN are complementary signals to each other, meaning when the first scan signal N is logic high, the second scan signal XN is logic low, and when the first scan signal N is logic low, the second scan signal XN is logic high. Voltage Vs represents voltage of the second end of the second transistor T2, and voltage Vg represents voltage of the control end of the second transistor T2.

Figure 3:
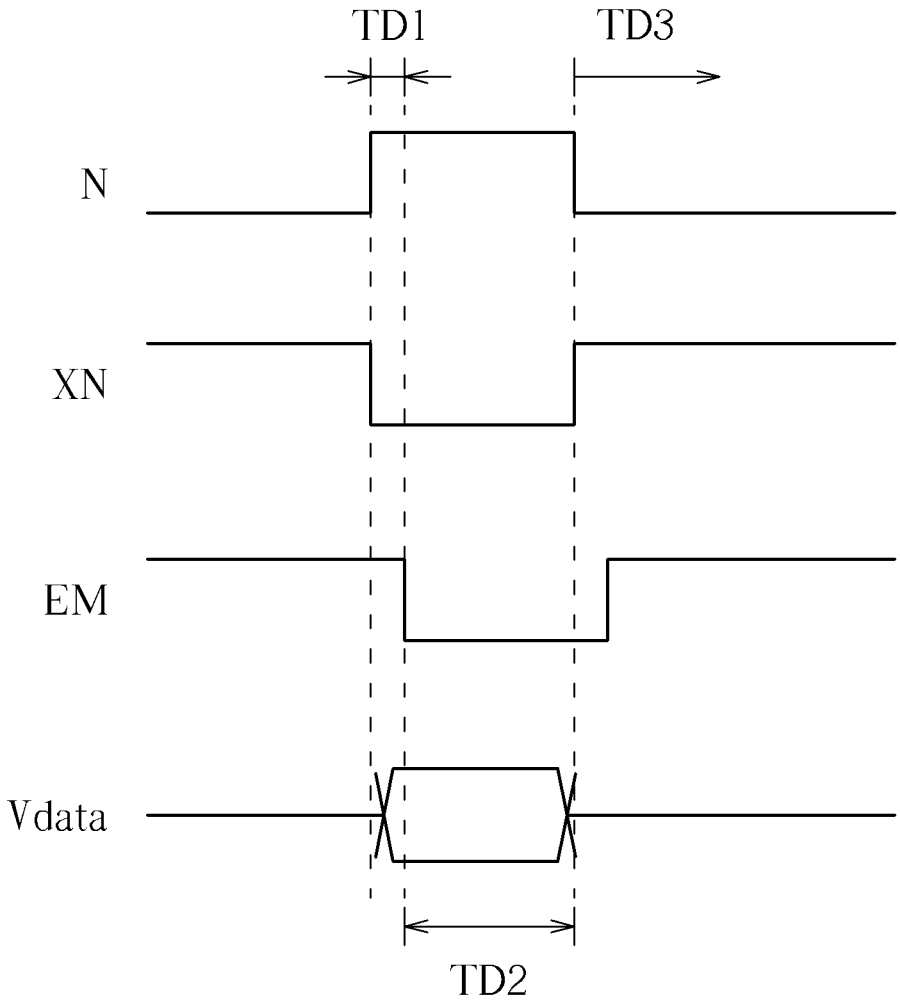
FIG. 3 is a waveform diagram illustrating operation of the pixel driving circuit of the organic light emitting diode in FIG. 2.

Please refer to FIG. 3. FIG. 3 is a waveform diagram illustrating operation of the pixel driving circuit of the organic light emitting diode in FIG. 2. The operation of the pixel driving circuit 20 comprises three stages: discharging, data writing, and emitting. The pixel driving circuit 20 performs discharging in duration TD1 for resetting the voltage Vs. In the duration TD1, the first scan signal N is logic high, and the second scan signal XN is logic low, so the first transistor T1 and the third transistor T3 are turned on and the fourth transistor T4 is turned off. Therefore, the voltage of the control end of the second transistor T2 is equivalent to the reference voltage (Vg=Vref). In the duration TD1, the driving signal EM is logic high, so the fifth transistor T5 is turned on. Hence, the capacitor Cst discharges through the fifth transistor T5, and the voltage Vs can be represented by formula (2):

$$Vs=OVSS+V_{OLED} \tag{2}$$

where the voltage $V_{OLED}$ represents a voltage difference between the first and second ends of the organic light emitting diode 22, thus voltage difference Vcst between the first and second ends of the capacitor Cst can be represented by formula (3):

$$Vcst=V\text{data}-Vs \tag{3}$$

The pixel driving circuit 20 performs data writing in duration TD2. In the duration TD2, logic values of the first scan signal N and the second scan signal XN remain unchanged, but the driving signal EM is transformed from logic high to logic low, so the fifth transistor T5 is turned off. In the data writing stage, a voltage difference between the control end and the second end of the second transistor T2 is equivalent to the threshold voltage Vth of the second transistor T2, for the voltage Vs to increase to (Vref−Vth). Hence the voltage difference Vcst between the first and second ends of the capacitor Cst can be represented by formula (4):

$$Vcst=V\text{data}-V\text{ref}+Vth \tag{4}$$

The pixel driving circuit 20 drives the organic light emitting diode 22 to perform emitting in duration TD3. In the duration TD3, the first scan signal N is transformed from logic high to logic low, and the second scan signal XN is transformed from logic low to logic high, so the first transistor T1 and the third transistor T3 are turned off and the fourth transistor T4 is turned on. In addition, the driving signal EM is transformed from logic low to logic high, and the fifth transistor T5 is turned on. A current $I_{OLED}$ for driving the organic light emitting diode 22 is determined by the second transistor T2, as represented by formula (5):

$$I_{OLED}=\tfrac{1}{2}k(Vgs-Vth)^2 \tag{5}$$

where the voltage Vgs represents a voltage difference between the control end and the second end of the second transistor T2. Since the fourth transistor T4 is turned on, Vgs=Vcst=Vdata−Vref+Vth and hence the current $I_{OLED}$ can be modified according to formula (6):

$$I_{OLED}=\tfrac{1}{2}k(V\text{data}-V\text{ref})^2 \tag{6}$$

According to formula (6), the driving current $I_{OLED}$ of the organic light emitting diode 22 is only related to the data voltage Vdata and the reference voltage Vref, which is mainly due to the pixel driving circuit 20 having compensated the threshold voltage of the transistor in the stage of data writing.

Figure 4:
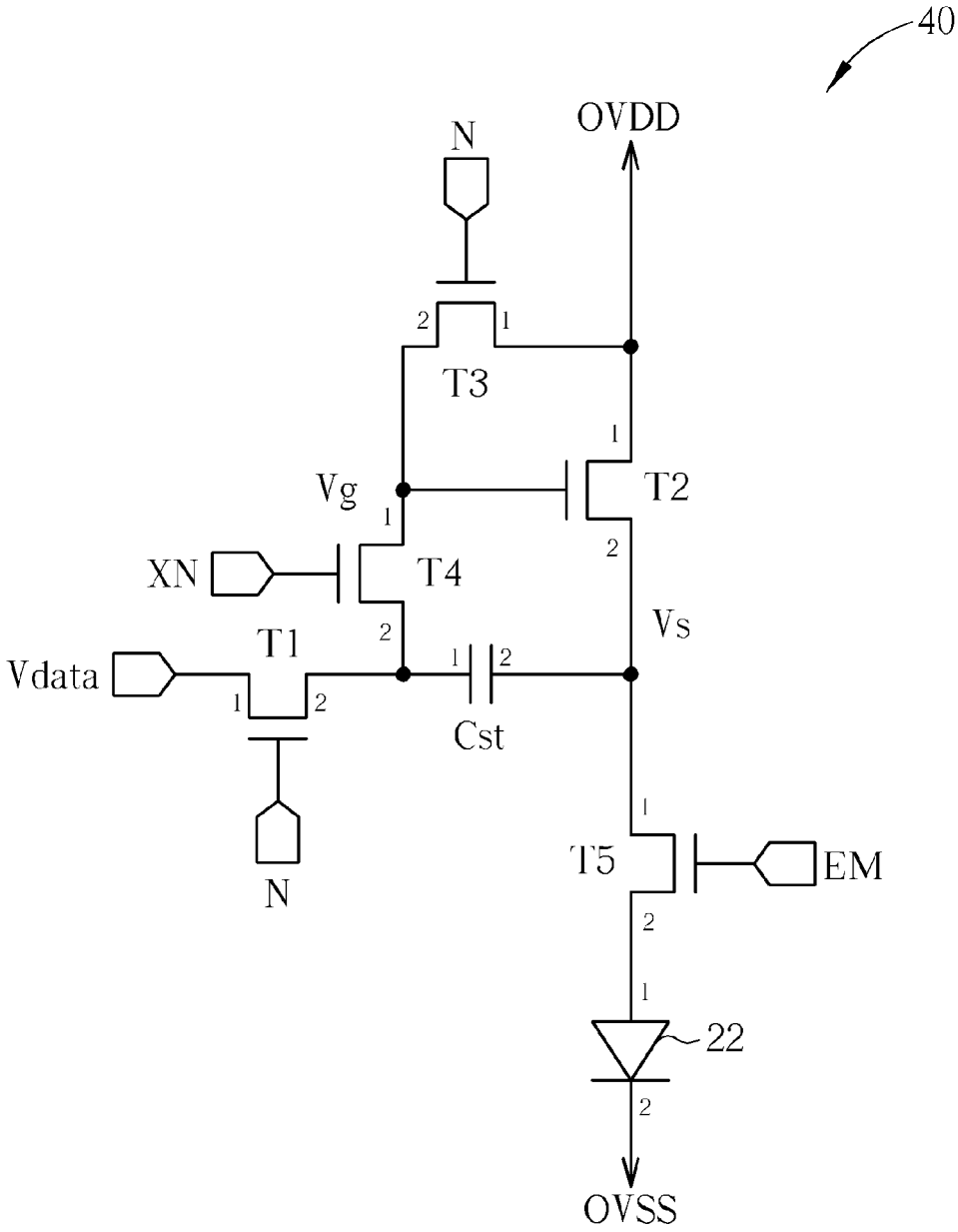
FIG. 4 is a diagram illustrating a pixel driving circuit of an organic light emitting diode according to a second embodiment of the present invention.

Please refer to FIG. 4. FIG. 4 is a diagram illustrating a pixel driving circuit of an organic light emitting diode according to a second embodiment of the present invention. In the second embodiment, the pixel driving circuit 40 comprises similar components to the first embodiment and the difference is the coupling relationship of the third transistor T3. Under the condition that a voltage level of the reference voltage Vref equals that of a voltage provided by the first voltage source OVDD, the first end of the third transistor T3 can be electrically connected to the first voltage source OVDD directly, while other coupling relationships remain unchanged. The second end of the third transistor T3 is electrically connected to the control end of the second transistor T2, and the control end of the third transistor T3 receives the first scan signal N. The second embodiment can save one reference voltage source.

Figure 5:
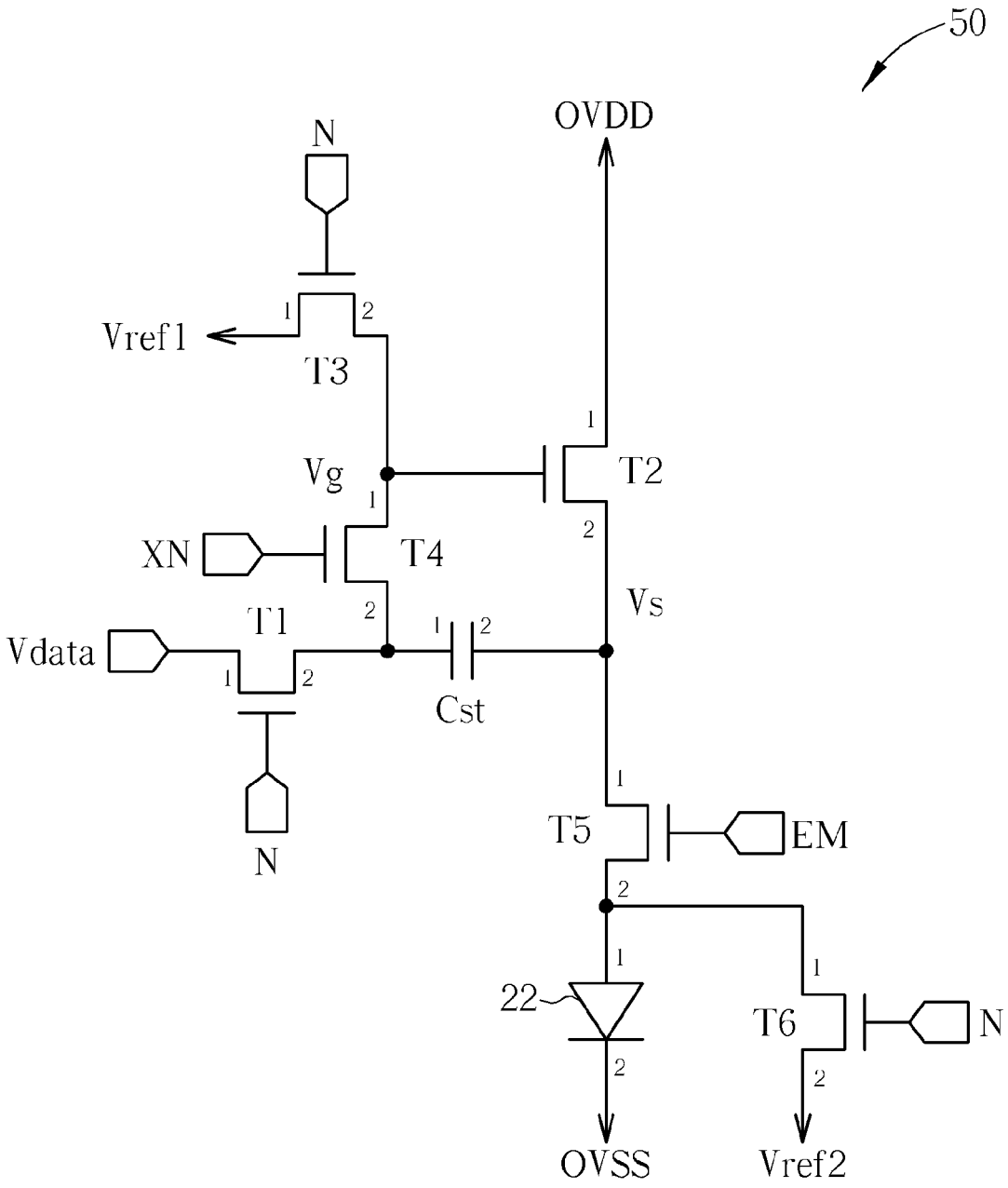
FIG. 5 is a diagram illustrating a pixel driving circuit of an organic light emitting diode according to a third embodiment of the present invention.

Please refer to FIG. 5. FIG. 5 is a diagram illustrating a pixel driving circuit of an organic light emitting diode according to a third embodiment of the present invention. In the third embodiment, the pixel driving circuit 50 comprises similar components to the first embodiment, but further comprises a sixth transistor T6, and utilizes a first reference voltage Vref1 and a second reference voltage Vref2. The first end of the third transistor T3 receives the first reference voltage Vref1, the second end of the third transistor T3 is electrically connected to the control end of the second transistor T2, and the control end of the third transistor T3 receives the first scan signal N. A first end of the sixth transistor T6 is electrically connected to the second end of the fifth transistor T5, a second end of the sixth transistor T6 receives the second reference voltage Vref2, and a control end of the sixth transistor T6 receives the first scan signal N. Similar to the first transistor T1 and the third transistor T3, the sixth transistor T6 is controlled by the first scan signal N, so the sixth transistor T6 is turned on when the pixel driving circuit 50 performs discharging and data writing, so as to prevent current from passing through the organic light emitting diode 22 in stages other than the emitting stage.

Figure 6:
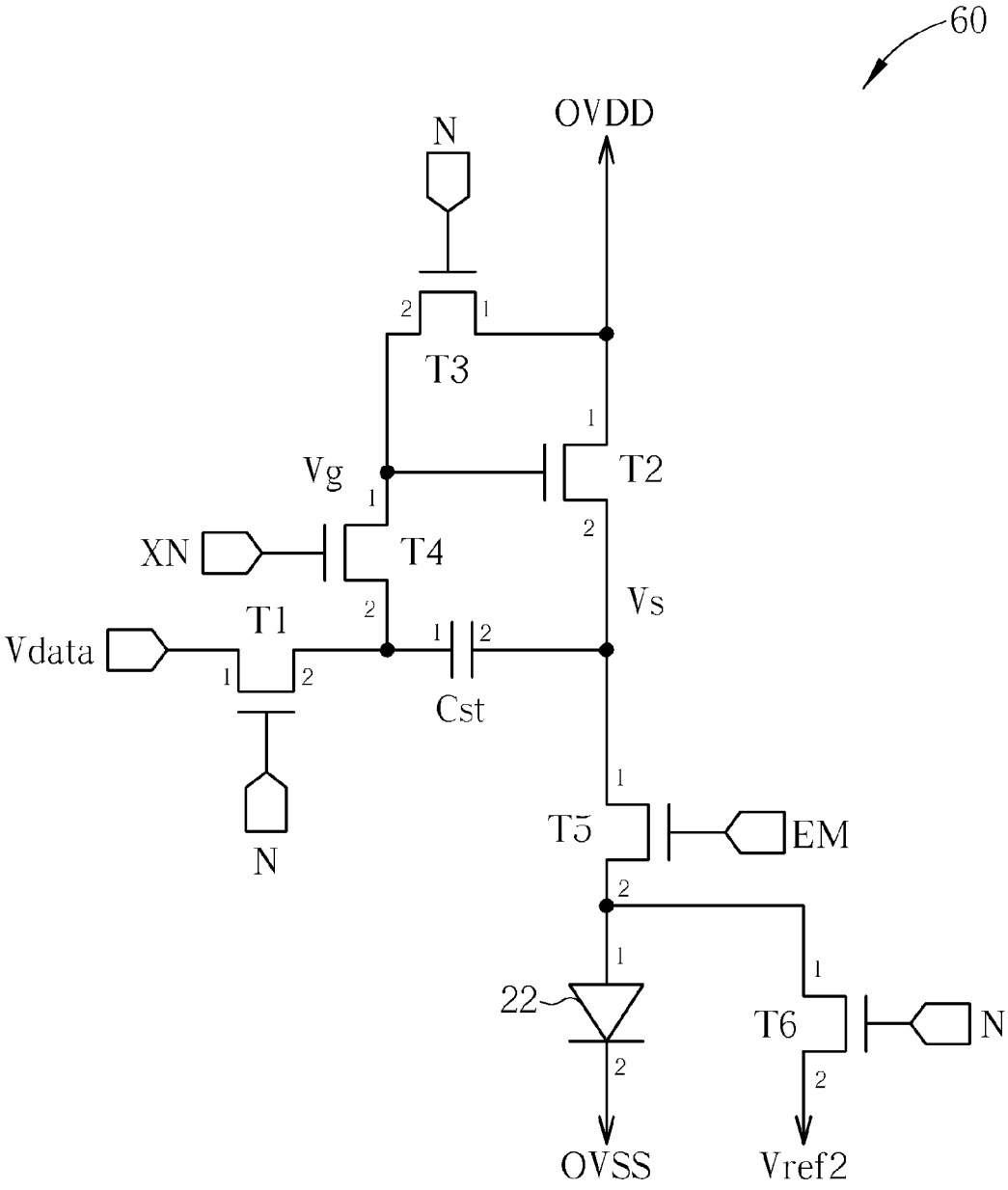
FIG. 6 is a diagram illustrating a pixel driving circuit of the organic light emitting diode according to a fourth embodiment of the present invention.

Please refer to FIG. 6. FIG. 6 is a diagram illustrating a pixel driving circuit of the organic light emitting diode 22 according to a fourth embodiment of the present invention. The fourth embodiment combines the second embodiment and the third embodiment. Differences between the pixel driving circuit 60 of the fourth embodiment and that of the first embodiment are the third transistor T3 and the sixth transistor T6. The first end of the third transistor T3 is electrically connected to the first voltage source OVDD, the second end of the third transistor T3 is electrically connected to the control end of the second transistor T2, and the control end of the third transistor T3 receives the first scan signal N. The first end of the sixth transistor T6 is electrically connected the second end of the fifth transistor T5, the second end of the sixth transistor T6 receives the second reference voltage Vref2, and the control end of the sixth transistor T6 receives the first scan signal N.

In summary, the pixel driving circuit of the organic light emitting diode of the present invention comprises a first transistor, a second transistor, a third transistor, a fourth transistor, a fifth transistor, a capacitor, and an organic light emitting diode. The operation of the pixel driving circuit comprises three stages of discharging, data writing, and emitting. The pixel driving circuit compensates the threshold voltage of the transistor in the stage of data writing, so the driving current of the organic light emitting diode is only relevant to the data voltage and the reference voltage. Therefore, the pixel driving circuit of the organic light emitting diode of the present invention is able to compensate inconsistent driving current caused by differences between threshold voltages of the transistors for improving differences in luminescence generated by the organic light emitting diodes and preventing the display panel from displaying an image with inconsistent luminance.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A pixel driving circuit of an organic light emitting diode, comprising:

a first transistor, comprising a first end for receiving a data voltage, a second end, and a control end for receiving a first scan signal;

a capacitor, comprising a first end electrically connected to the second end of the first transistor, and a second end;

a second transistor, comprising a first end electrically connected to a first voltage source, a control end, and a second end electrically connected to the second end of the capacitor;

a third transistor, comprising a first end for receiving a first reference voltage, a second end electrically connected to the control end of the second transistor, and a control end for receiving the first scan signal;

a fourth transistor, comprising a first end electrically connected to the control end of the second transistor, a second end electrically connected to the second end of the first transistor, and a control end for receiving a second scan signal;

a fifth transistor, comprising a first end electrically connected to the second end of the capacitor, a second end, and a control end for receiving a driving signal; and an organic light emitting diode, comprising a first end electrically connected the second end of the fifth transistor, and a second end electrically connected to a second voltage source, wherein the first scan signal is complementary to the second scan signal.

2. The pixel driving circuit of claim 1, wherein a voltage level of the first reference voltage equals a voltage level of a voltage provided by the first voltage source.

3. The pixel driving circuit of claim 1, wherein the first reference voltage is an independent voltage source.

4. The pixel driving circuit of claim 1, further comprising:

a sixth transistor, comprising a first end electrically connected to the second end of the fifth transistor, a second end for receiving a second reference voltage, and a control end for receiving the first scan signal.

5. The pixel driving circuit of claim 1, wherein the first transistor, the second transistor, the third transistor, the fourth transistor and the fifth transistor are N-type transistors.

6. The pixel driving circuit of claim 1, wherein when the first transistor, the third transistor and the fifth transistor are turned on and the fourth transistor is turned off, the capacitor discharges via the fifth transistor for resetting a voltage of the second end of the second transistor.

7. The pixel driving circuit of claim 1, wherein when the first transistor and the third transistor are turned on and the fourth transistor and the fifth transistor are turned off, a voltage of the second end of the second transistor is generated according to the first reference voltage and a threshold voltage of the second transistor.

8. The pixel driving circuit of claim 1, wherein when the fourth transistor and the fifth transistor are turned on and the first transistor and the third transistor are turned off, the organic light emitting diode is driven to emit light according to a current generated by the data voltage and the first reference voltage.

9. A pixel driving circuit of an organic light emitting diode, comprising:

a first transistor, comprising a first end for receiving a data voltage, a second end, and a control end for receiving a first scan signal;

a capacitor, comprising a first end electrically connected to the second end of the first transistor, and a second end;

a second transistor, comprising a first end electrically connected to a first voltage source, a control end, and a second end electrically connected to the second end of the capacitor;

a third transistor, comprising a first end for receiving a first reference voltage, a second end electrically connected to the control end of the second transistor, and a control end for receiving the first scan signal;

a fourth transistor, comprising a first end electrically connected to the control end of the second transistor, a second end electrically connected to the second end of the first transistor, and a control end for receiving a second scan signal;

a fifth transistor, comprising a first end electrically connected to the second end of the capacitor, a second end, and a control end for receiving a driving signal; and an organic light emitting diode, comprising a first end electrically connected the second end of the fifth transistor, and a second end electrically connected to a second voltage source, wherein when the first transistor and the third transistor are turned on and the fourth transistor and the fifth transistor are turned off, a voltage of the second end of the second transistor is generated according to the first reference voltage and a threshold voltage of the second transistor.

10. A pixel driving circuit of an organic light emitting diode, comprising:

a first transistor, comprising a first end for receiving a data voltage, a second end, and a control end for receiving a first scan signal;

a capacitor, comprising a first end electrically connected to the second end of the first transistor, and a second end;

a second transistor, comprising a first end electrically connected to a first voltage source, a control end, and a second end electrically connected to the second end of the capacitor;

a third transistor, comprising a first end for receiving a first reference voltage, a second end electrically connected to the control end of the second transistor, and a control end for receiving the first scan signal;

a fourth transistor, comprising a first end electrically connected to the control end of the second transistor, a second end electrically connected to the second end of the first transistor, and a control end for receiving a second scan signal;

a fifth transistor, comprising a first end electrically connected to the second end of the capacitor, a second end, and a control end for receiving a driving signal; and an organic light emitting diode, comprising a first end electrically connected the second end of the fifth transistor, and a second end electrically connected to a second voltage source, wherein when the fourth transistor and the fifth transistor are turned on and the first transistor and the third transistor are turned off, the organic light emitting diode is driven to emit light according to a current generated by the data voltage and the first reference voltage.

* * * * *